United States Patent [19]

Stange

[11] 4,188,110

[45] Feb. 12, 1980

[54] PHOTOCONDUCTIVE BELT SUPPORTING APPARATUS

[75] Inventor: Klaus K. Stange, Pittsford, N.Y.

[73] Assignee: Xerox Corporation, Stamford, Conn.

[21] Appl. No.: 892,809

[22] Filed: Apr. 3, 1978

[51] Int. Cl.[2] ..... G03G 15/00

[52] U.S. Cl. ..... 355/3 BE; 226/118; 226/195; 355/4; 355/16; 430/42

[58] Field of Search ..... 355/3 R, 3 BE, 4, 16; 226/113, 118, 195; 96/1 R

[56] References Cited

U.S. PATENT DOCUMENTS

| | | | |
|---|---|---|---|
| 3,176,894 | 4/1965 | Schoeneman | 226/118 |
| 3,500,694 | 3/1970 | Jones et al. | 74/241 |
| 3,664,204 | 5/1972 | Jordan | 74/219 |
| 3,820,985 | 6/1974 | Gaynor et al. | 355/3 BE X |
| 3,827,801 | 8/1974 | Tanaka et al. | 355/16 X |
| 3,836,245 | 9/1974 | Hastwell et al. | 355/16 X |
| 4,046,473 | 9/1977 | Trainor | 355/3 R X |
| 4,110,758 | 8/1978 | Nelson et al. | 226/113 X |

*Primary Examiner*—Fred L. Braun

[57] ABSTRACT

A high speed color reproduction machine comprised of four separate xerographic type processing units, one for each of the primary colors plus black. The multiple processing units are arranged in close nested relationship to one another with the image transfer stations thereof in close succession along the path of movement of the copy substrate material. A combination air flotation type and vacuum based belt transport system is employed to bring copy substrate material from a supply source into transfer relation with the successive processing units. Exposure of the processing unit's photoreceptors is simultaneous. A precise dimensional relationship between photoreceptor length and spacing for each processing unit assures registration of the color images produced with one another. Following transfer of the last color image, the image bearing copy material is brought to a fuser where the image is fixed. The finished copy is thereafter discharged, or returned for a second duplex pass. The photoreceptor of each processing unit comprises an endless photoconductive belt. The length of each photoconductive belt is the same. Vacuum tensioning is employed with each belt to provide preset belt lengths between exposure and transfer stations for each processing unit. A flying spot type exposure system is used with laser light source and optical elements to simultaneously project independent image exposure beams to the exposure stations of the several processing units.

6 Claims, 4 Drawing Figures

PHOTOCONDUCTIVE BELT SUPPORTING APPARATUS

BACKGROUND OF THE INVENTION

This invention relates to a color reproduction apparatus, and more particularly to a high speed color reproduction apparatus.

Reproducing or copying color originals through a xerographic process has, in the past, entailed the sequential production of three color separation images of the colored original, with independent development thereof by cyan, magenta and yellow toners. The images so formed are transferred onto the copy substrate material in registered overlaying relationship, with the resulting composite color image being fused to provide a permanent full color reproduction of the original.

In the aforedescribed color process, black is obtained through an amalgam of the three color toners. However, it is often useful to provide a separate processing unit devoted solely to black. This addition enhances machine versatility since it is then possible to produce black and white copies directly and without the need to go through the color separation cycle. The addition of a separate black processing unit also enhances the quality and faithfulness of the black in color reproductions inasmuch as black is formed directly using black toner rather than a combination of multi-color toners.

However, while systems of the above type can provide full color reproductions, because of the need to process three and possibly four color separation images for each copy, the copy output is often very low. Where a single photoconductive drum is used for example, normally each color separation image is created, developed, and transferred to the copy substrate material before the next is started.

Where multiple photoreceptor processing units have been suggested to speed up copy output, it has often been at the expense of greatly increased machine physical size required to accommodate three and possibly four photoreceptor processing units. Attempts to alleviate this problem and reduce machine size through the use of different diameter photoreceptor drums or belts results in a system wherein a multiplicity of different size photoreceptor drums of belts must be stocked for replacement purposes, it being understood that photoreceptor drums and belts are subject to fatigue and damage and hence must be replaced from time to time.

SUMMARY OF THE INVENTION

The invention relates to a high speed apparatus for reproducing copies of full color originals on copy substrate material from multiple color component images of the originals by means of controlled recording beams, each of the beams being associated with an individual one of the color component images, comprising in combination, means forming a path for the copy substrate material; a generally triangular photoconductive belt module associated with each of the recording beams, each of the belt modules including an endless photoconductive belt with means for supporting the belt for movement along an endless path, the belt modules being positioned in closely spaced side-by-side relation with one apex of each belt module in operative disposition with the copy substrate path at minimally spaced intervals therealong; means for developing the color component images formed on the belts; and means forming a transfer point along each of the belts at the one apex whereat color component images developed on the belts are successively transferred to the copy substrate material in registered superimposed relation to form full color copies of the originals.

The invention further relates to a support apparatus for photoconductive belts, comprising in combination: at least two rotatable spaced apart belt supporting rolls forming a belt run therebetween; means for drivingly rotating at least one supporting roll; an endless photoconductive belt disposed over the supporting rolls, the length of the belt being greater than the length of the belt run formed by the supporting rolls; means forming a vacuum chamber interior of the belt run; and means for evacuating the vacuum chamber to draw the excess length of the belt into the chamber to form a U-shaped belt loop while tensioning the belt to provide driving engagement with the belts.

DESCRIPTION OF INVENTION

Figure 1:
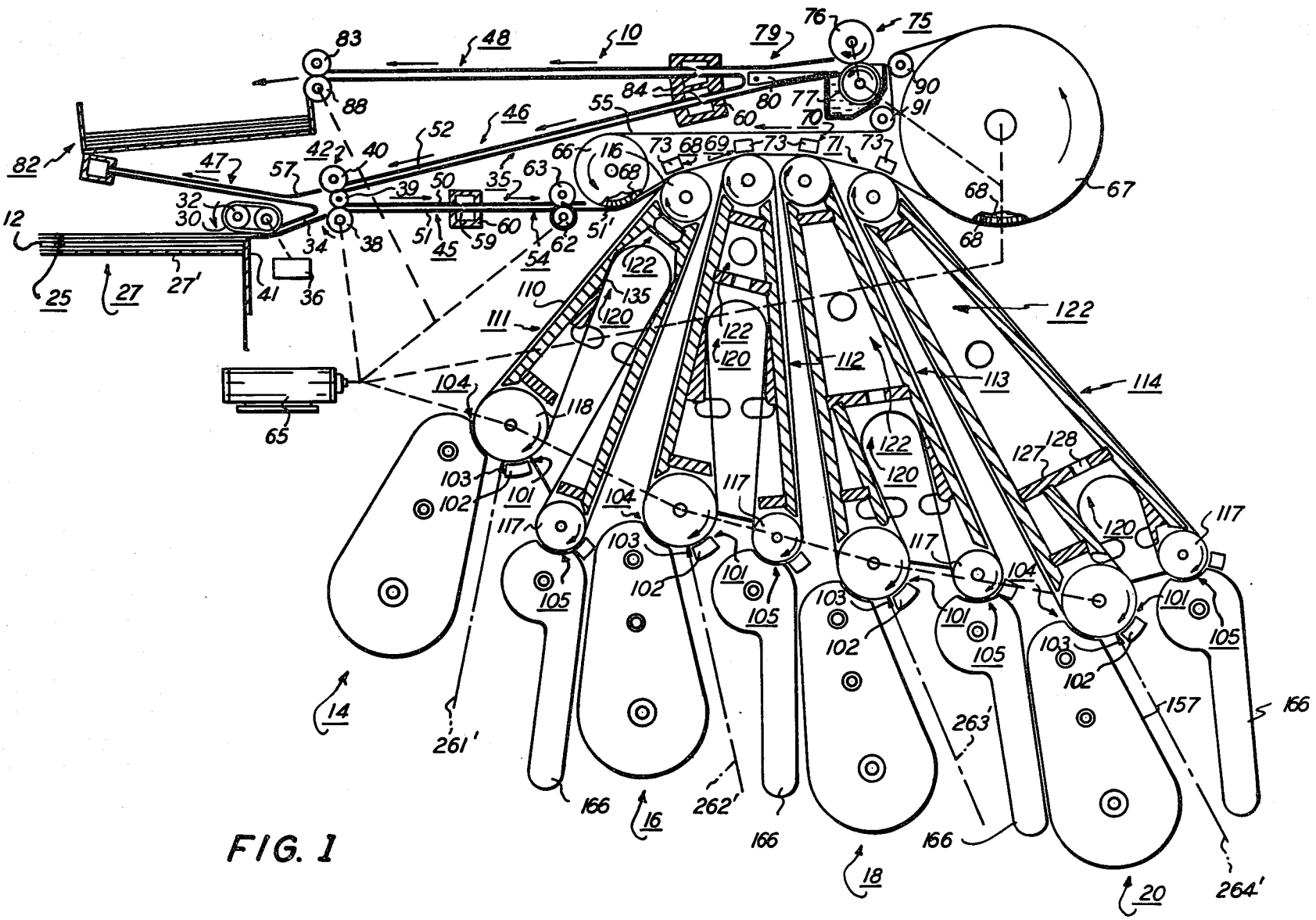
FIG. 1 is a plan view of the color reproduction apparatus of the present invention.

Referring particularly to FIG. 1 of the drawings, there is shown the hi speed four color processor, designated generally by the numeral 10, of the present invention. As will appear, processor 10 provides color or black and white copies of originals on a suitable copy substrate material exemplified herein by copy sheets 12.

Processor 10 includes multiple xerographic type processing units 14, 16 and 18 for processing color component images or separations which when combined produce full color copies of color originals together with processing unit 20 for processing black only. It will be understood that where black and white copies are desired, only processing unit 20 need be activated.

Processing units 14, 16 and 18 process the three primary color components, namely cyan, magenta, and yellow respectively in a manner understood by those skilled in the art. It will be understood that processing unit 20 may be dispensed with and processing units 14, 16 and 18 relied upon to provide black through the xerographic color process.

As shown in the drawings, the design and arrangement of processor 10 permits the multiple processing units 14, 16, 18 and 20 to be disposed closely adjacent to one another with the image transfer stations 68, 69, 70 and 71 thereof in close succession along the copy sheet path.

A supply of copy substrate material, here shown as a stack 25 of copy sheets 12, is provided in a suitable paper tray 27. A sheet feeder in the form of feed belt 30 entrained about roller pair 32 serves to advance the topmost sheet from stack 25 forward into sheet inlet runway 34 of pneumatic sheet conveyor system 35. Suitable means (not shown) are provided to incrementally elevate base 27' of tray 27 as sheets 12 are drawn off of the top of the sheet stack 25 to maintain the topmost sheet of stack 25 in operative contact with feed belt 30.

Roller pair 32, which are rotatably supported by suitable journaling means (not shown), are drivingly coupled to a suitable step motor 36. Motor 36, when actuated, rotates roller pair 32 for a predetermined interval in the direction shown by the solid line arrow to drive feed belt 30 and advance the topmost sheet on stack 25 forward into sheet inlet runway 34 and the nip of rollers 38, 39 of tri-roller inverter 42. Gate 41 restricts feeding of sheets from sheet stack 25 to one sheet at a time.

Pneumatic sheet conveyor system 35 includes sheet inlet runway 34, feeder runway 45, duplex return runway 46, inverter runway 47, and copy discharge runway 48, each runway comprising a closed chute-like passage 54 for copy sheets bounded by upper and lower walls 50, 51 and side walls 52. When communicated with a relatively low pressure air stream, copy sheets introduced into the runways 35, 45, 46, 47 and 48 are carried therewithin in the direction of air flow. As will appear, runways 34, 45, 46, 47 and 48 are operatively coupled together to form together with copy sheet transport belt 55, a transport or conveyor system for copy sheets 12.

A four way junction 57 couples sheet inlet runway 34, sheet feeder runway 45, duplex return runway 46, and inverter runway 47 together. Copy sheets advanced by feed belt 30 pass through inlet runway 34 via junction 57 to sheet feeder runway 45, runway 45 leading to and exiting adjacent to copy transport belt 55. Sheet feeder runway 45 includes an air inlet 59 in communication with air supply duct 60 for introducing transporting air into the copy sheet conveyor system. A sheet register comprised of roller pair 62, 63 adjacent the discharge end of runway 45 serves to engage and register the copy sheets therewithin with the images in process by developing units 14, 16, 18 and 20. Rollers 62, 63 are driven from main drive motor 65 in unison with copy transport belt 55 and with photoconductive belts 110 of processing units 14, 16, 18 and 20.

Copy transport belt 55 comprises an endless perforated belt of suitable flexible material stretched about rotatable vacuum idler and driving drums 66, 67 respectively. Drums 66, 67 are rotatably supported by suitable journaling means (not shown). Driving drum 67 is driven by main motor 65 in the direction shown by the solid line arrow. Drums 66, 67 are hollow and have perforations 68 about the periphery thereof to permit sub-atmospheric pressure to be applied via the perforated copy transport belt 55 to tack copy sheets 12 thereto. The interior of drums 66, 67 communicate with a suitable source of sub-atmospheric pressure (not shown). Guide rollers 90, 91 guide belt 55 through a relatively sharply curved path downstream of drum 67 to facilitate separation of copy sheets 12 therefrom and into the nip formed by rollers 76, 77 of fuser 75. Guide rollers 90, 91 are rotatably supported by suitable journaling means (not shown).

To facilitate transfer of the copy sheets from sheet feeder runway 46 to copy transfer belt 55, the lower wall of runway 45 is extended at 51'. Extension 51' has a configuration complementary to the arcuate shape of drum 46.

A succession of image transfer stations 68, 69, 70, and 71, each associated wit a belt module 111, 112, 113, and 114 respectively, are disposed in close proximity to one another along the portion of copy transport belt 55 laying between drums 66, 67, belt modules 111, 112, 113, and 114 being disposed such that the uppermost portion of the photoconductive belt 110 is in predetermined pressure contact with transport belt 55.

A transfer corotron 73 is provided opposite each belt module 111, 112, 113, and 114 and interior of copy transport belt 55. Corotrons 73 serve to transfer the images developed on their respective belts 110 onto copy sheets 12 as the sheets are transported therepast by copy transport belt 55, such transfer taking place in accordance with well known principles of xerography. Where multi-color copies are being produced, the color component images are transferred in registered superimposed relation.

Following transfer of the developed image or images onto copy sheets 12, the sheets are carried by copy transport belt 55 to a fuser 75 whereat the images are fixed by heat. Fuser 75 comprises an upper heated fuser roll 76 and cooperating lower pressure roll 77 in driving engagement with one another. Fuser rolls 76, 77 are drivingly connected to motor 65, motor 65 rotating rolls 76, 77 in the direction indicated by the solid line arrow.

A pneumatic junction 79 is provided downstream of fuser 75, junction 79 leading to duplex return runway 46 and to copy discharge runway 48 of pneumatic sheet conveyor system 35. Deflector gate 80 in junction 79 serves to selectively route copy sheets leaving fuser 75 into either runway 46 or 48.

Copy discharge runway 48 conveys the copy sheets bearing the fused image to a copy output station, exemplified herein by copy tray 82, wherein the finished copies are accumulated. Roller pair 83, 88 facilitate discharge of the copy sheets from copy discharge runway 48 into the tray 82. While the copy output station is illustrated as comprising a copy tray, other types of copy output stations, i.e., a sorter, may be contemplated.

Copies routed by deflector gate 80 into duplex return runway 46 are carried back to junction 57 where the copies are inverted to permit a second image to be formed on the unused side thereof. For this purpose, the copy sheets are passed by junction 57 and roller pair 39, 40 of tri-roller inverter 42 into deadend inverter runway 47. It will be understood that rollers 38, 39 and 40 of tri-roller inverter 42 are supported for rotation by suitable journaling means (not shown) and are driven by motor 65 in the direction shown by the solid line arrow.

As the trailing edge of a copy sheet exits from the nip of rollers 39, 30, the sheet trailing edge is carried by roller 39 downwardly and effectively directed into the nip of rollers 38, 39. Rollers 38, 39 in cooperation with the flow of transporting air reverse the direction of sheet movement and move the now inverted sheet into sheet feeder runway 45 for a second pass through the processing apparatus.

Duplex return runway 46 and sheet discharge runway 48 are provided with air inlets at 84 for communication with transporting air supply duct 60.

Processing units 14, 16, 18, and 20 each comprise a complete xerographic sub-assembly, the principle processing elements of which comprise a charging station 101, exposure station 103, developing station 104, cleaning station 105, and transfer station (the latter having been previously identified by numerals 68, 69, 70, and 71) in operative disposition about an endless photoconductive belt 110 supported on a belt module 111, 112, 113, and 114 respectively.

Figure 2:
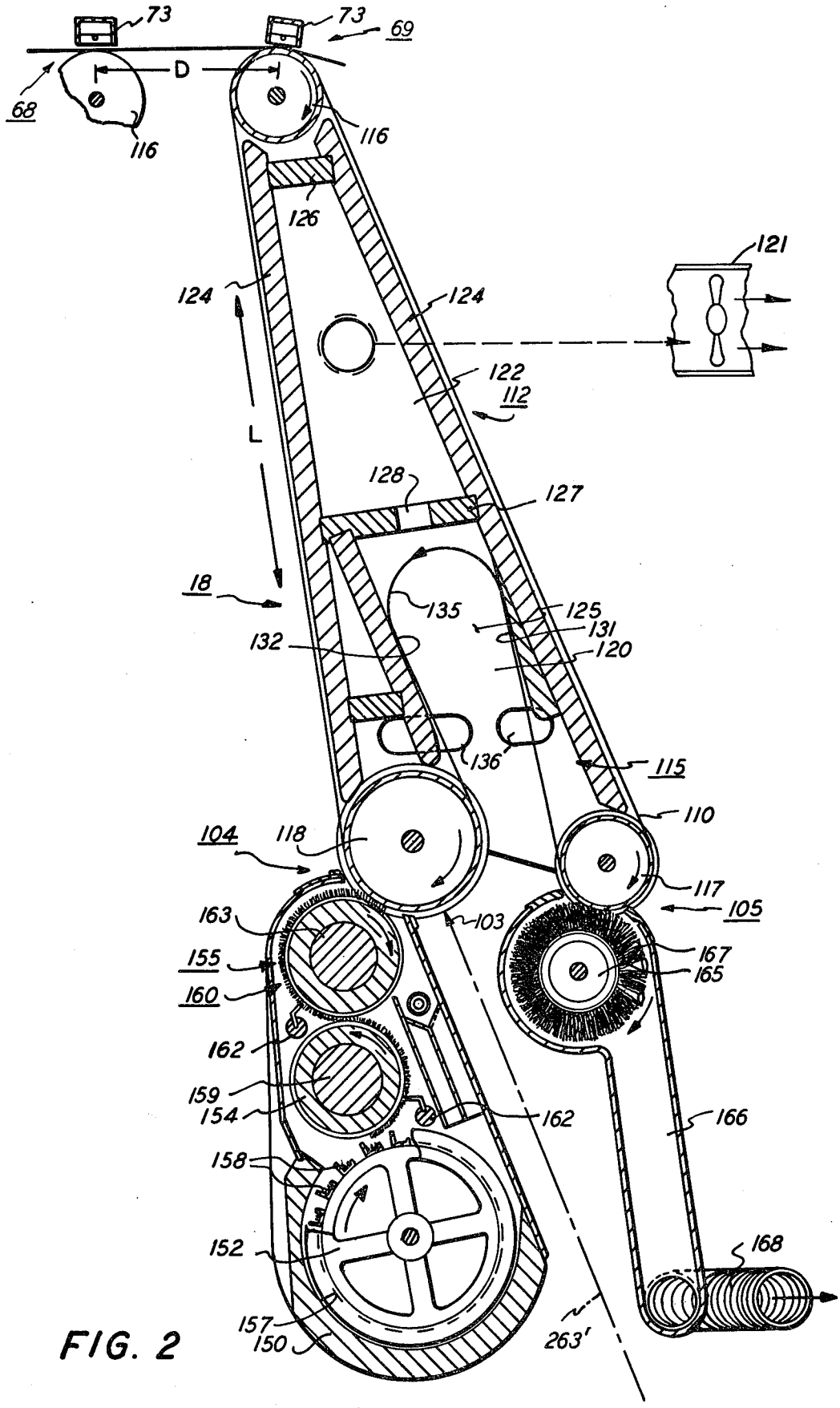
FIG. 2 is an enlarged view of one xerographic belt module illustrating details of the vacuum belt tensioning mechanism.

Referring particularly to FIG. 2, belt modules 111, 112, 113, 114 each comprise a generally triangular shaped support frame 115 having photoconductive belt support rollers 116, 117, and 118 mounted thereon at the apices of the triangle. Rollers 116, 117 and 118 are supported for rotation about fixed axes in frame 115 by means of suitable bearings (not shown) with roller 118 thereof being drivingly coupled to main motor 65. Belt module frames 115 are each recessed internally in varying degrees at 120. A hollow sub-atmospheric or vacuum chamber 122 is formed within the confines of each frame 115 by the frame side and end walls 124, 125 respectively, and by upper and lower frame cross members 126, 127 respectively, chamber 122 extending across the width of the respective belt modules. A transverse opening or port 128 in lower frame cross member 127 communicates vacuum chamber 122 with recessed portion 120 thereof. The interior surfaces of frame side walls 124 are suitably beveled at 131, 132 to provide side support to the loop portions 135 of photoconductive belts 110 formed therein during operation. Pressure relief ports 136 in end walls 125 permit ingress of air to enable the requisite belt attracting air flow patterns to be generated.

To assure registration of succeeding color component images with the preceding image or images, the belt modules 112, 113, 114 are sized so that the length L of the belt run from exposure station 103 to transfer stations 69, 70, 71 thereof is equal to the length L of the preceding belt module 111, 112, 113 plus the distance d. from the transfer station 68, 69 or 70 of the preceding belt module 111, 112, 113 respectively to the transfer station 69, 70, or 71 of the succeeding belt module 112, 113, 114 respectively.

Photoconductive belts 110 comprise any suitable photoconductive material such as selenium supported on a suitable flexible substrate or backing, such as polyester film. To promote serviceability and reduce cost, the photoconductive belts 110 for all belt modules 111, 112, 113, 114 are the same size, with an overall length greater than the minimum belt run formed by belt modules 111, 112, 113, 114.

To accommodate the aforedescribed spatial relationship between successive belt modules while permitting interchangeable belts 110 to be used, the depth of the recess 120 for each belt module 111, 112, 113, 114 varies. In the arrangement shown, recess 120 of belt module 111 is largest with the recesses 120 of the succeeding belt modules 112, 113 and 114 being progressively smaller. As a result, the size of the belt loop 135 established in the several recesses during operation of the system 10 is progressively smaller with each successive belt module 111, 112, 113, 114. Evacuation of chamber 122 while processing copies creates a pressure differential across the segment of the photoconductive belt 110 adjacent the belt module recesses 120 which draws the belt segment into the recess to form belt loop 135 and tension the photoconductive belts about rollers 116, 117, 118 of belt modules 111, 112, 113, 114.

Developing stations 104 comprise any suitable image developing devices. Developing stations 104 are exemplified herein by a developer housing 150 having pickup roll 152 and magnetic or mag brush type intermediate feed and developer rolls 154, 155 respectively housed therewithin. The lower portion of developer housing 150 forms a sump 157 for the supply of developing material, pickup roll 152 being in operative disposition therewith in sump 157. Pickup roll 152 has a succession of cavities 158 in the periphery thereof for transporting developing material from sump 157 into operative juxtaposition with intermediate feed roll 154.

Developing material from pickup roll 152 is magnetically attracted to the surface of feed roll 154 by the magnetic field created by magnets 159 thereof, resulting in the formation of a developer blanket 160. Following trimming thereof by trim bar 162, the blanket of developing material is carried upwardly by roll 154 to developer roll 155. Developer roll 155, in turn, carries the developer, attracted thereto by magnets 163 thereof, into operative relation with the surface of photoconductive belt 110 at developing station 104. Rolls 152, 154, 155 of developing stations 104 are rotatably supported in developer housing 150 thereof by suitable journaling means (not shown) and are driven in the direction shown by the solid line arrows by main motor 65.

Cleaning stations 105 each comprise, in the exemplary arrangement shown, a rotatable cleaning brush 165 disposed in housing 166, brush 165 being supported for rotation by suitable journaling means (not shown) such that bristles 167 thereof are in wiping contact with the surface of photoconductive belt 110. Cleaning brush 165 is driven by main motor 65. Leftover developing material and any other debris, removed from belt 110 by brush 165 is carried from housing 166 by means of suction, the lower portion of housing 166 being connected to vacuum exhaust duct 168 for this purpose.

Figure 3:
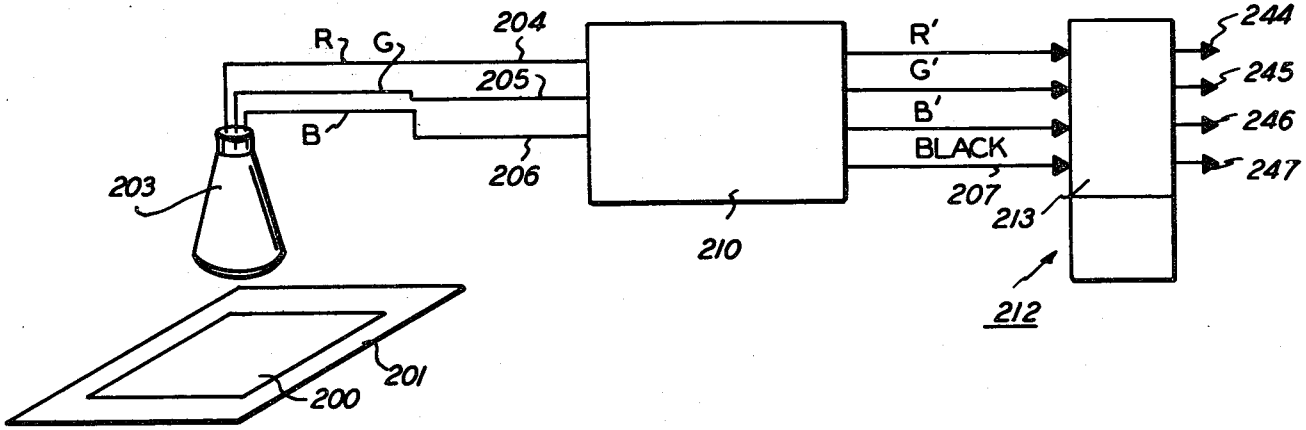
FIG. 3 is a schematic view showing a color image signal generating means.

Digital signals representing the primary color separations, i.e. red, green, and blue, of a colored original to be reproduced, together with black may be provided in any suitable manner. For example, and referring to FIG. 3, a colored original 200, which is disposed upon a suitable support such as platen 201, may be scanned by a conventional video type color camera 203. The color output signals of camera 203 are fed through input channels 204, 205, 206 to a suitable matrix control network 210 wherein the signals may be optimized in accordance with predetermined algorithms. The resulting color separation signals are stored in a suitable memory 213 under the direction of computer 212 pending use.

Network 210 additionally generates digital signals representing the fourth color image i.e. black. The black image signals are obtained through comparative analysis of the red, green, and blue color separation signals in accordance with a predetermined algorithm. The black image signals are fed to memory 213 through input channel 207.

Figure 4:
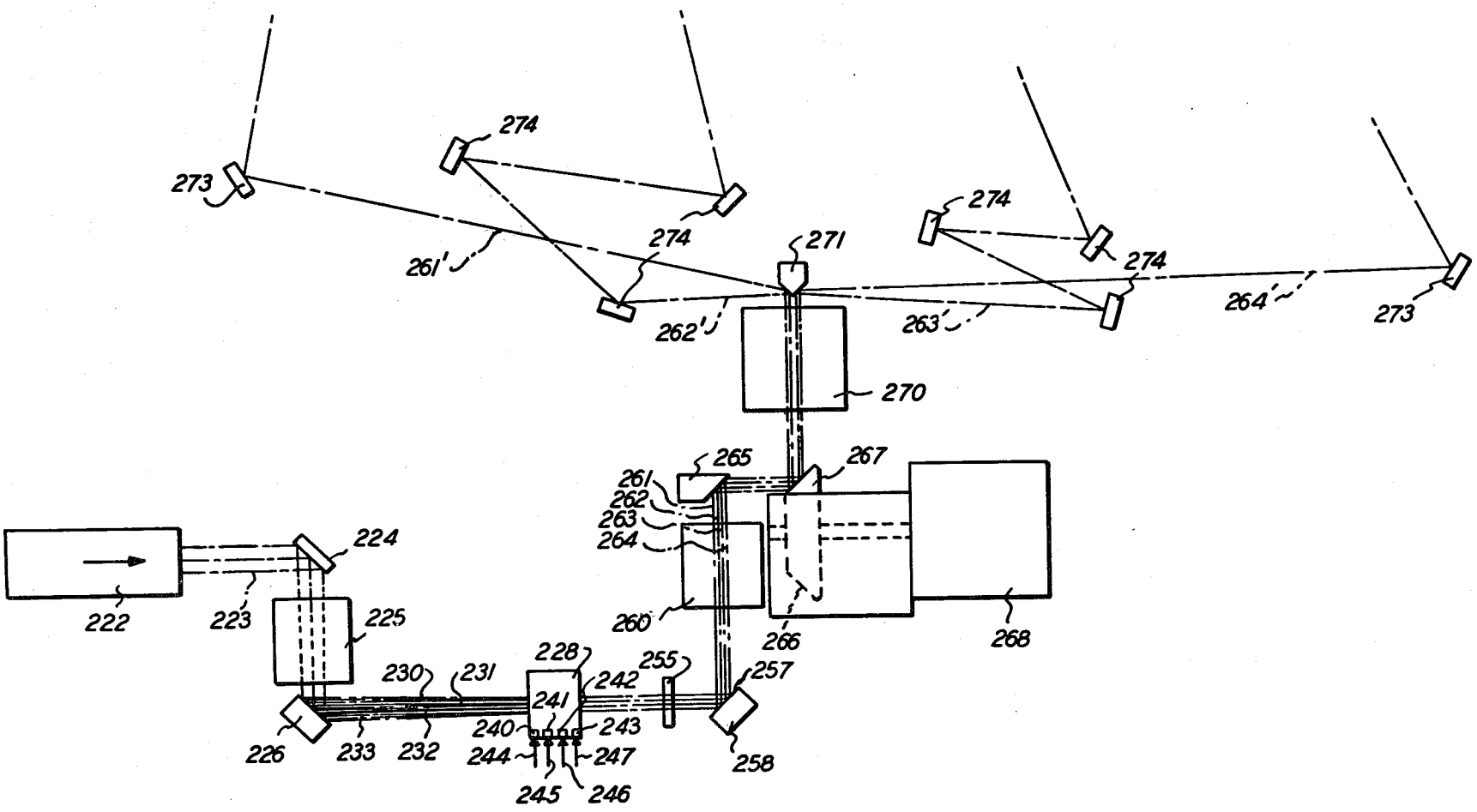
FIG. 4 is a plan view showing details of the imaging system for the color reproduction apparatus of FIG. 1.

Referring to FIG. 4 of the drawings, a flying spot type imaging system is thereshown effective to provide image rays representative of the three primary color separations and black at exposure stations 103 of developing units 14, 16, 18, 20 in response to the image signals stored in memory 213. For this purpose, a suitable source of light, i.e. laser 222 is provided. The light beam 223 produced by laser 222 is directed by mirror 224 through lens 225 and onto four faceted mirror 226. Mirror 226 divides the beam 223 into four distinct light beams 230, 231, 232, 233 which, through the action of lens 225, are focused at four channel acousto-optical modulator 228.

The color separation image signals, together with the black image signals in memory 213 are inputed to the respective beam control gates 240, 241, 242, 243 of modulator 228, along signal output channels 244, 245, 246, 247. It will be understood that the image signals stored in memory 213 are addressed by computer 212 in synchronism with the operating speed of the reproduction system 10.

As will be understood by those skilled in the art, the individual control gates 240, 241, 242, 243 of modulator 228 respond to the binary state (i.e. "1" or "0") of the image signals applied thereto through channels 244, 245, 246, 247 respectively to direct the light beams 230, 231, 232, 233 associated therewith either toward a suitable beam stop 255 or toward the individual facets 257 of four faceted mirror 258. Beam stop 255 intercepts light directed thereagainst to block further passage thereof.

Light striking mirror 258 is reflected therefrom to expander lens 260 which restores the light into four parallel paths 261, 262, 263, 264. It is understood that the discrete light patterns along the parallel light paths 261, 262, 263, 264 are representative of the three color separation images and black comprising the full color original 200. From lens 260, the now parallel light paths are directed by mirror 265 onto the facets 266 of rotating scanning polygon 267. Polygon 267 is rotated by motor 268 at a speed proportional to the movement of photoconductive belts 110.

The multiple scanning light paths 261, 262, 263, 264 reflected from facets 266 of polygon 267 are focused by main imaging lens 270 onto the surface of photoconductive belts 110 at imaging stations 103 of the processing units 14, 16, 18, 20. A triangular shaped four faceted mirror 271 routes the light paths into separate branches 261', 262', 263', 264' leading to the various imaging stations 103, branches 261', 264' being routed by single mirrors 273 to the imaging stations of processing units 14 and 20 while branches 262', 263' are routed by three mirror combination 274 to the imaging stations of processing units 16 and 18.

In operation of processing system 10, the light beam generated by laser 222, which serves as the exposure medium for the photoconductive belts 110, is broken up into four independent paths 261, 262, 263, 264, one for each exposure station 103 of processing units 14, 16, 18, 20. The continuity of the four light beams 230, 231, 232, 233 is controlled in accordance with the image signals from memory 213 through acousto-optical modulator 228. The imaging beams scan or traverse across the photoconductive belts at imaging stations 103 from edge to edge, with each photoconductive belt 110 being exposed simultaneously.

Prior to exposure of the photoconductive belts 110, the source of vacuum which may for example comprise a single stage blower 121 of the type made and sold by Lamb Electric Corp. for vacuum chambers 122 of belt modules 111, 112, 113, 114 is energized to draw the excess portion of belts 110 into the recessed areas 120 and tension the belts. Main motor 65 is energized to drive photoconductive belts 110 and operate the several xerographic processing components, i.e. developing station 104, associated therewith. Power is supplied to charge and transfer corotrons 102,73 respectively, the former serving to place a uniform electrostatic charge on belts 110 in preparation for imaging. The source of pressure air to air supply ducts 60 of pneumatic sheet conveyor system 35 is energized.

At a predetermined time during the copying cycle, step motor 36 is actuated to drive sheet feed belt 30 and advance the topmost sheet 12 in tray 27 forward into the sheet inlet runway 34 and the nip of rolls 38, 39. The sheet is carried into sheet feeder runway 45 with the leading edge thereof registered by register roll pair 62, 63 with the leading edge of the color separation images developed on photoconductive belts 110.

Exposure of the charged photoconductive belts 110 at exposure stations 103 selectively discharges the belt in accordance with the light pattern applied thereto to create latent color separation electrostatic images on each photoconductive belt 110. The latent electrostatic images so produced are developed by the respective cyan, magenta, yellow and black developers of processing units 14, 16, 18, 20 to form the four color separation images. The developed separation images are transferred in succession at image transfer stations 68, 69, 70, 71 to the copy sheet carried therepast by copy transport belt 55. The copy sheet, bearing the composite color image, is carried to fuser 75 whereat the color image is fixed. The copy sheet may be thereafter transported via copy discharge runway 48 to output tray 82 or where a second or duplex image is desired on the unused side thereof, returned to the sheet feeder runway 45 via duplex return runway 46 and inverter runway 47.

While the invention has been described with reference to the structure disclosed, it is not confined to the details set forth, but is intended to cover such modifications or changes as may come within the scope of the following claims:

What is claimed is:

1. Photoreceptor support apparatus comprising in combination:

(a) at least two rotatable spaced apart belt supporting rolls, said rolls defining a belt run therebetween;

(b) an endless photoconductive belt disposed over said rolls, the length of said belt being greater than the length of the belt run defined by said rolls;

(c) means for drivingly rotating at least one of said rolls to produce uniform uninterrupted movement of said belt along the entire length of said belt;

(d) means forming a vacuum chamber interior of said belt run; and (e) means for evacuating said chamber to draw the excess length of said belt into said chamber whereby to form a U-shaped belt loop while tensioning said belt to provide operative engagement with said rolls.

2. The photoconductive belt supporting apparatus of claim 1 in which said vacuum chamber includes predetermined air escape ports on either side of said belt to control vacuum force on said belt.

3. The photoconductive belt supporting apparatus of claim 1 in which said evacuating means includes control means for regulating the size of said belt loop and tension on said belt.

4. In an electrostatic type reproduction machine having an endless movable photoreceptor belt, means for charging said belt in preparation for imaging, exposure means for exposing said belt to an original to form a latent electrostatic image of said original on said belt, developing means for developing said image, transfer means for transferring the developed image to copy support material, and cleaning means for cleaning said belt to remove residual developer prior to reuse of said belt, the combination of:

(a) a first support roll for said belt opposite said developing means;

(b) a second support roll for said belt opposite said transfer means;

(c) a third support roll for said belt opposite said cleaning means; said support rolls comprising the sole support for said belt and cooperating to form an endless belt run for said photoreceptor belt;

(d) drive means for rotating at least one of said first, second and third support rolls to produce uniform uninterrupted movement of said belt about said endless belt run;

(e) the length of said belt being greater than the length of the photoreceptor belt run formed by said support rolls; and (f) vacuum tensioning means between said first and third rolls for drawing the excess length of said belt into a loop whereby to tension said belt and maintain said belt in operative engagement with said support rolls.

5. Tracking means for an endless photoconductive belt comprising:

(a) a frame;

(b) at least two rollers supported for rotation in said frame, the axes of rotation of said rollers being fixed, said rollers cooperating to form a belt run for said photoconductive belt;

(c) drive means for rotating at least one of said rollers to produce uniform non-stop movement of the entire belt around said belt run;

(d) the length of said photoconductive belt being greater than said belt run;

(e) a vacuum chamber formed in said frame, said chamber communicating with said belt run; and (f) means for evacuating said chamber to draw the excess length of said photoconductive belt into said chamber and variably tension said belt across the belt width in accommodation of mistracking forces.

6. A method for operatively supporting an endless overlong photoconductive belt of an electrostatic type copying apparatus having a charging station whereat the photoconductive surface of said belt is charged in preparation for imaging, an exposure station whereat the charged photoconductive surface of said belt is exposed to form a latent electrostatic image of the original being copied, a developing station whereat said developed image is transferred to a copy support material, and a cleaning station whereat the photoconductive surface of said belt is cleaned preparatory to reuse, the steps comprising:

(a) supporting said belt for movement in an endless loop extending past said charging, exposure, developing, transfer, and cleaning stations;

(b) evacuating a portion of said belt loop behind said belt to draw said belt inwardly to differentially tension said belt in accommodation of mistracking forces; and (c) moving said belt without interruption of any part of said belt along said endless loop.

* * * * *